United States Patent [19]

Fisher et al.

[11] Patent Number: 5,076,892

[45] Date of Patent: Dec. 31, 1991

[54] APPARATUS FOR PRESSURIZED REFINING OF LIGNOCELLULOSE MATERIAL

[75] Inventors: Chester D. Fisher, Muncy; Randall L. Musselman, Lewisburg; Gregory R. Kohler, Williamsport; Gary W. Allshouse; Heinz O. Backhust, both of Muncy; William F. Lahner, III, Lewisburg, all of Pa.

[73] Assignee: Sprout-Bauer Inc., Muncy, Pa.

[21] Appl. No.: 383,379

[22] Filed: Jul. 20, 1989

[51] Int. Cl.[5] ..... D21B 1/22; B02C 7/00; B02C 7/14

[52] U.S. Cl. ..... 162/261; 162/23; 162/26; 241/161; 55/52; 55/199

[58] Field of Search ..... 241/161, 162, 163; 162/17, 18, 23, 26, 52, 241, 246, 261; 55/1, 52, 199, 204

[56] References Cited

U.S. PATENT DOCUMENTS

| | | | |
|---|---|---|---|
| 2,864,562 | 12/1958 | Eberhardt et al. | 241/160 |
| 3,257,173 | 6/1966 | Parnell | 55/199 |
| 3,323,731 | 6/1967 | Asplund et al. | 241/146 |
| 3,388,037 | 6/1968 | Asplund et al. | 162/28 |
| 3,441,227 | 4/1969 | Fisher . | |
| 3,661,328 | 5/1972 | Leask | 241/18 |
| 3,773,610 | 11/1973 | Shouvlin et al. | 162/261 |
| 3,847,359 | 11/1974 | Holmes et al. | 241/34 |
| 3,893,631 | 7/1975 | Fisher et al. | 241/37 |
| 4,037,772 | 7/1977 | Peterson | 162/23 |
| 4,082,233 | 4/1978 | Reinhall | 162/23 |
| 4,298,425 | 11/1981 | Ranzen et al. | 162/18 |
| 4,395,047 | 7/1983 | Lahner, III . | |
| 4,555,254 | 11/1985 | Fisher . | |
| 4,700,900 | 10/1987 | Rowland . | |
| 4,710,268 | 12/1987 | Nilsson . | |

FOREIGN PATENT DOCUMENTS

| | | |
|---|---|---|
| 1387685 | 2/1965 | France . |
| 2356763 | 1/1978 | France . |
| WO86/06769 | 11/1986 | PCT Int'l Appl. . |
| WO88/08050 | 10/1988 | PCT Int'l Appl. . |

*Primary Examiner*—Richard V. Fisher
*Assistant Examiner*—Todd J. Burns

[57] ABSTRACT

A multi-stage process, and apparatus for carrying out the process, are provided for refining lignocellulose containing material at high consistency. The lignocellulose material is pretreated to form a mixture of the lignocellulose material and pressurized steam conveyed via the pressure of the pressurized steam to a first refiner, wherein the lignocellulose material is conveyed mechanically into a first refining zone within the first refiner while causing the pressurized steam in the mixture to pass in reverse direction to the lignocellulose to a steam venting outlet to vent the steam from the first refiner. The lignocellulose material fed into the first refining zone is subjected to refining action thereby producing a mixture of partially refined lignocellulose material and pressurized steam developed during the refining action. This mixture of partially refined lignocellulose material and pressurized steam is conveyed via the pressure of the pressurized steam to a second refiner, wherein the partially refined lignocellulose material in the mixture is conveyed mechanically into a second refining zone in said second refiner while causing the pressurized steam in said mixture to pass in reverse direction to the lignocellulose material to a steam venting outlet to vent the steam from the second refiner. The lignocellulose material fed into the second refining zone is subjected to refining action thereby producing a mixture of further refined lignocellulose material and steam developed during said refining action. The further refined lignocellulose material is discharged from the second refiner and separated from the steam developed during the refining action.

6 Claims, 6 Drawing Sheets

APPARATUS FOR PRESSURIZED REFINING OF LIGNOCELLULOSE MATERIAL

BACKGROUND OF THE INVENTION

The present invention relates generally to the refining of lignocellulose material, such as wood chips, in a pressurized environment, and more particularly, to a multi-stage method for refining lignocellulose material, and an apparatus for carrying out the method, wherein the lignocellulose material is refined at pressure in at least an upstream stage refining zone and a downstream stage refining zone with the lignocellulose material being pneumatically transported between stages by the steam generated in the upstream stage refining zone. The method may be advantageously carried out by using disc-type refiners and, most advantageously, utilizing disc-type refiners incorporating high speed shaft driven ribbon feeders.

It is well known in the art to stage, that is to place in series, a plurality of refining zones, typically two, to produce mechanical or chemi-mechanical or thermo-mechanical pulp from lignocellulose material, most commonly wood chips. In such conventional systems, it is the common practice to pass the lignocellulose material at a high consistency through a first pressurized refining zone to produce a semi-refined pulp entrained in steam generated within the first refining zone. The semi-refined pulp entrained in the steam generated in the first refining zone is passed directly to a steam separating device, most commonly a cyclone, wherein the steam is separated from the semi-refined pulp and the semi-refined pulp is then conveyed, most typically by a screw feeder, to a second stage refining zone. The semi-refined pulp is further refined in the second refining zone to produce a fully refined pulp again entrained in steam generated within the refining zone. The fully refined pulp and steam mixture generated in the second refining zone is discharged directly to a second steam separating cyclone wherein the steam is separated from the pulp and the fully refined pulp recovered.

Typically, such multi-stage, high consistency refining is carried out utilizing in combination a first stage refiner, followed by a steam separating cyclone, followed by pulp conveyor means, followed by a second stage refiner. One such system is shown in U.S. Pat. No. 3,661,328 wherein the wood chips to be refined are first pretreated and then passed to a first stage refiner comprising a pressurized double rotating disc refiner wherein the chips are initially refined to produce a partially refined pulp. The partially refined pulp is conveyed in steam generated in the pressurizing refiner zone within the double rotating disc refiner directly to a steam separating cyclone wherein the partially refined pulp is separated from the steam and recovered. The partially refined pulp is then fed from the discharge of the steam separating cyclone by a screw conveyor directly to a second refiner comprising an atmospheric double rotating disc refiner.

Another method and apparatus for the multi-stage, high consistency refining of wood chips and other lignocellulose material through staged independent refiners is disclosed in U.S. Pat. No. 4,298,425. As shown therein, the wood chips are first subjected to a grinding operation in the refining zone of a pressurized rotating disc type defibrator to produce a partially refined pulp consisting of a flocculent mass of initially separated and freed fibers entrained in steam generated within the first stage refiner, such steam typically having a temperature of 110° to 140° C. The partially refined pulp is conveyed in the steam generated within the first stage refiner directly from the discharge of the first stage refiner to a steam separating cyclone wherein the partially refined pulp is separated from the steam and the steam is recovered. The separated partially refined pulp is then passed from the discharge of the steam recovery cyclone through a screw conveyor to a second stage refiner which again is a rotating disc defibrator wherein the pulp material is further refined to product the final product pulp.

Such conventional multi-stage, high consistency refining of lignocellulose material may also be carried out using a single machine incorporating two refining zones such as shown in U.S. Pat. No. 4,700,900. As disclosed therein, the high consistency refining is accomplished using a refiner which has two virtually identical but separate refining zones defined in a single machine. The wood chips to be processed are first fed by means of a screw conveyor to the first stage refining zone and subjected to defibrating therein to form a partially refined pulp entrained in steam generated within the refining zone. The partially refined pulp entrained in the steam generated in the first refining zone is discharged therefrom directly to a steam separating cyclone disposed interstage between the first stage refining zone and the second stage refining zone. The partially refined pulp is separated from the steam generated within the first refining zone and discharged from the steam separating cyclone directly to a screw conveyor which feeds the partially refined pulp to the second stage refining zone within the machine wherein the partially refined pulp is further refined to produce the final fully refined pulp product.

It would be advantageous if the partially refined pulp could be discharged from the first stage of the refining zone and conveyed in the steam generated within the first refining zone directly into a ribbon feeder for conveying the partially refined pulp to second refining zone and separating the steam therefrom without the use of an interstage cyclone. Heretofore, the direct transfer of partially refined pulp from a first refining stage to a second refining stage has been limited to low consistency pulping operations wherein steam is not generated within the refining zone. In low consistency pulping systems, that is systems wherein the pulp is processed in an aqueous slurry having a solids content of less than about 4% by weight, steam is not generated in the refining step due to the fact that there is sufficient liquid in the aqueous pulp slurry to absorb the heat generated during the refining step without the formation of steam. For example, as shown in U.S. Pat. Nos. 2,864,562 and 3,323,731, two pairs of grinding discs disposed within the same machine are operated in series with the outlet of the first refining zone connected by a substantially U-shaped conduit directly to the inlet of the second refining zone. After the pulp fed to the first refining zone between the first set of grinding discs is subjected to a grinding treatment therein, the partially refined pulp resulting therefrom is conveyed directly to the inlet to the second refining zone between the second pair of grinding discs wherein further grinding treatment is carried out to produce the final product pulp.

It is an object of the present invention to provide a high consistency pressurized multi-stage refining method, and an apparatus for carrying out the method, wherein the lignocellulose material is refined under high consistency pressurized conditions in at least an upstream refining zone and a downstream refining zone with the lignocellulose material being conveyed directly from the outlet of the first refining zone to a ribbon feeder feeding the second refining zone in the steam generated in the upstream stage refining zone. In high consistency refining, that is refining wherein the pulp is processed in a gaseous slurry having a solids content of 15% by weight or greater, and generally a solids content of 20% to 50% by weight, there is insufficient liquid in the pulp slurry to absorb the heat generated during the refining step without the formation of steam. Naturally, the higher the solids content, i.e. the consistency, of the pulp slurry, the greater the amount of steam generated during the refining step.

SUMMARY OF THE INVENTION

In accordance with the method aspect of the present invention, there is provided a multi-stage process, and apparatus for carrying out the process, for refining lignocellulose containing material comprising the steps of pretreating the lignocellulose material to form a mixture of the lignocellulose material and pressurized steam, conveying said mixture of lignocellulose material and pressurized steam via the pressure of the pressurized steam to a first refining means, mechanically conveying the lignocellulose material in the mixture into a refining zone between a pair of opposed refining discs of the first refining means while causing the pressurized steam in the mixture to pass in reverse direction to the lignocellulose to a steam venting outlet to vent the steam from the first refining means, subjecting the lignocellulose material fed into the refining zone of the first refining means to refining action between a pair of relatively rotating opposed refining discs thereby producing a mixture of partially refined lignocellulose material and pressurized steam developed during the refining action, conveying the mixture of partially refined lignocellulose material and pressurized steam via the pressure of the pressurized steam to a second refining means, mechanically conveying the partially refined lignocellulose material in the mixture into a refining zone between a pair of opposed refining discs in said second refining means while causing the pressurized steam in said mixture to pass in reverse direction to the lignocellulose material to a steam venting outlet to vent the steam from the second refining means, subjecting the lignocellulose material fed into the refining zone of the second refining means to refining action between the relatively rotating refining disc thereby producing a mixture of further refined lignocellulose material and steam developed during said refining action. The further refined lignocellulose material discharged from the second refining means is separated from the steam developed during the refining action in the second refiner means thereby recovering the further refined lignocellulose material.

DESCRIPTION OF THE PREFERRED EMBODIMENT

Figure 1:
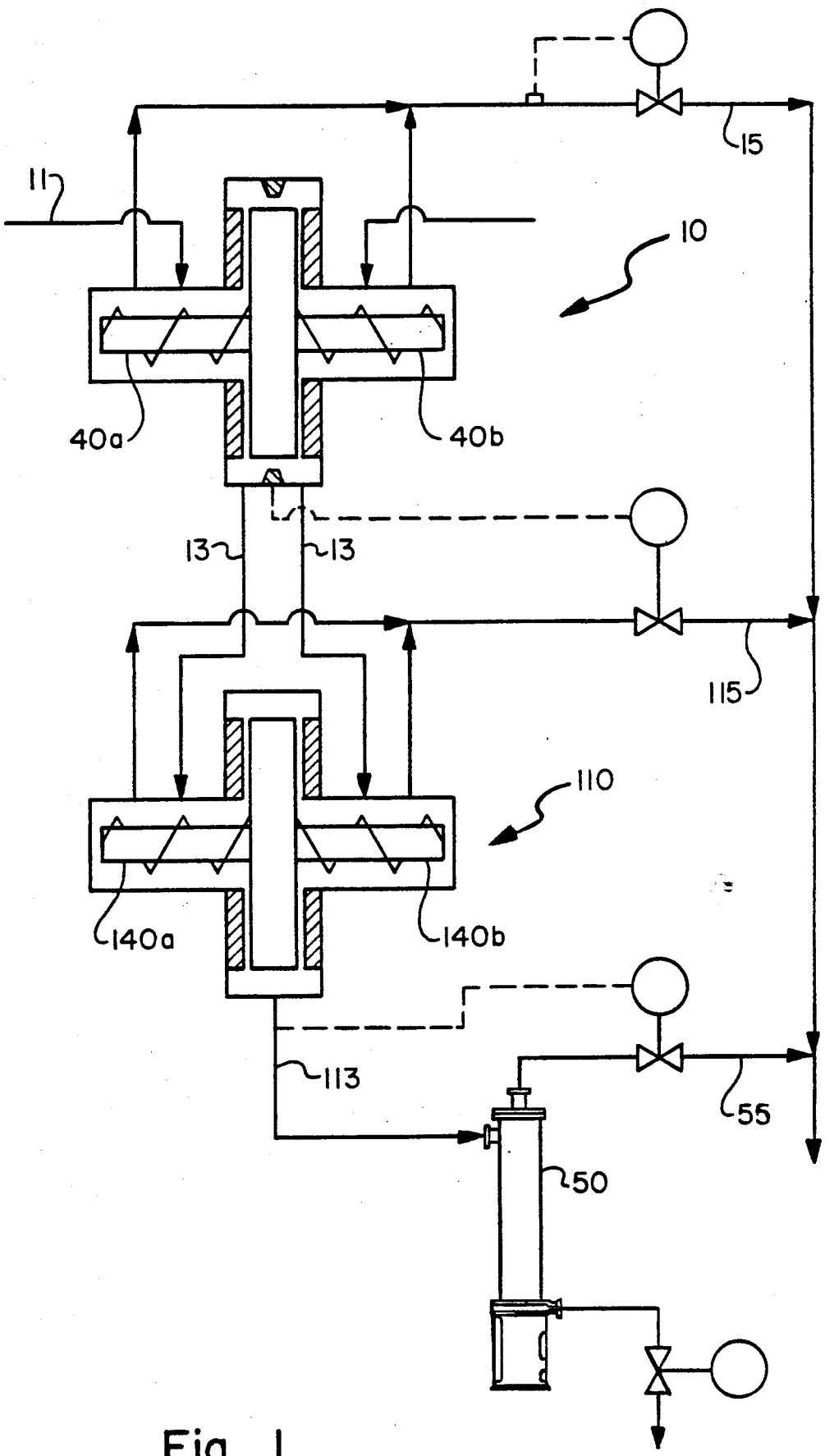
FIG. 1 is a schematic view of the multi-stage refining process of the present invention carried out in a pair of high consistency refiners disposed in series.
Figure 2:
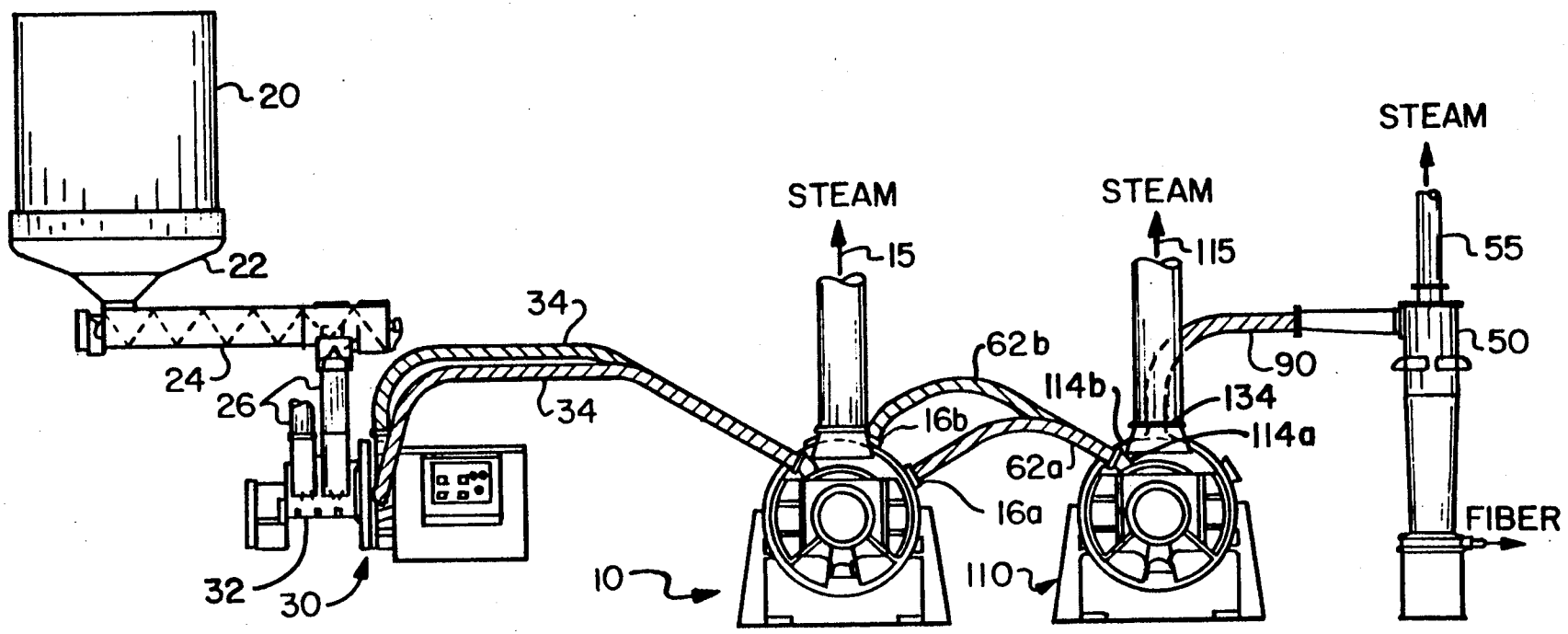
FIG. 2 is an elevational side view of a pair of high consistency refiners arranged to carry out the multi-stage refining process of FIG. 1.
Figure 3:
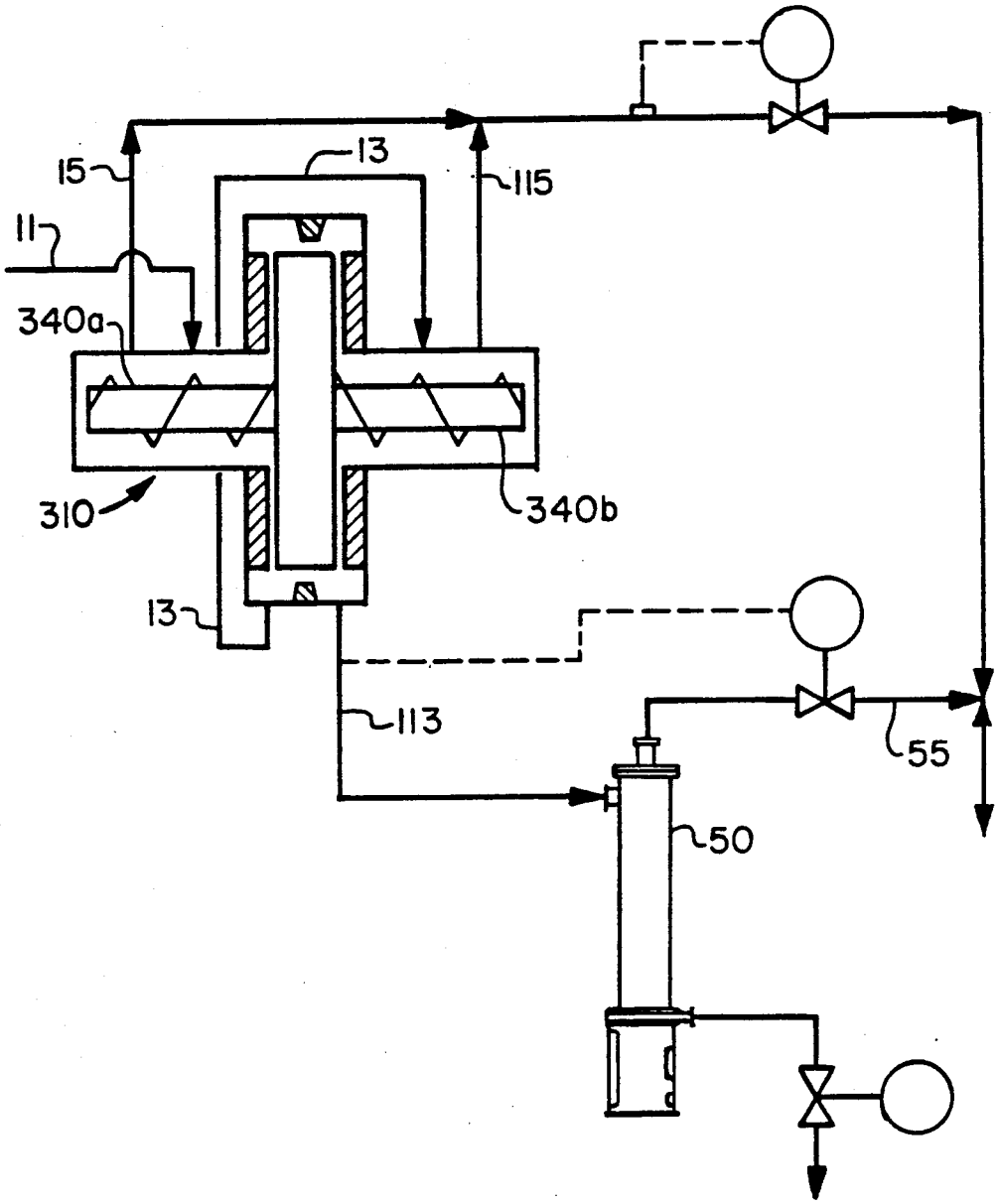
FIG. 3 is a schematic drawing of the multi-stage process of the present invention carried out using a single high consistency refiner with the first refining zone and the second refining zone thereof interconnected in series flow relationship.
Figure 4:
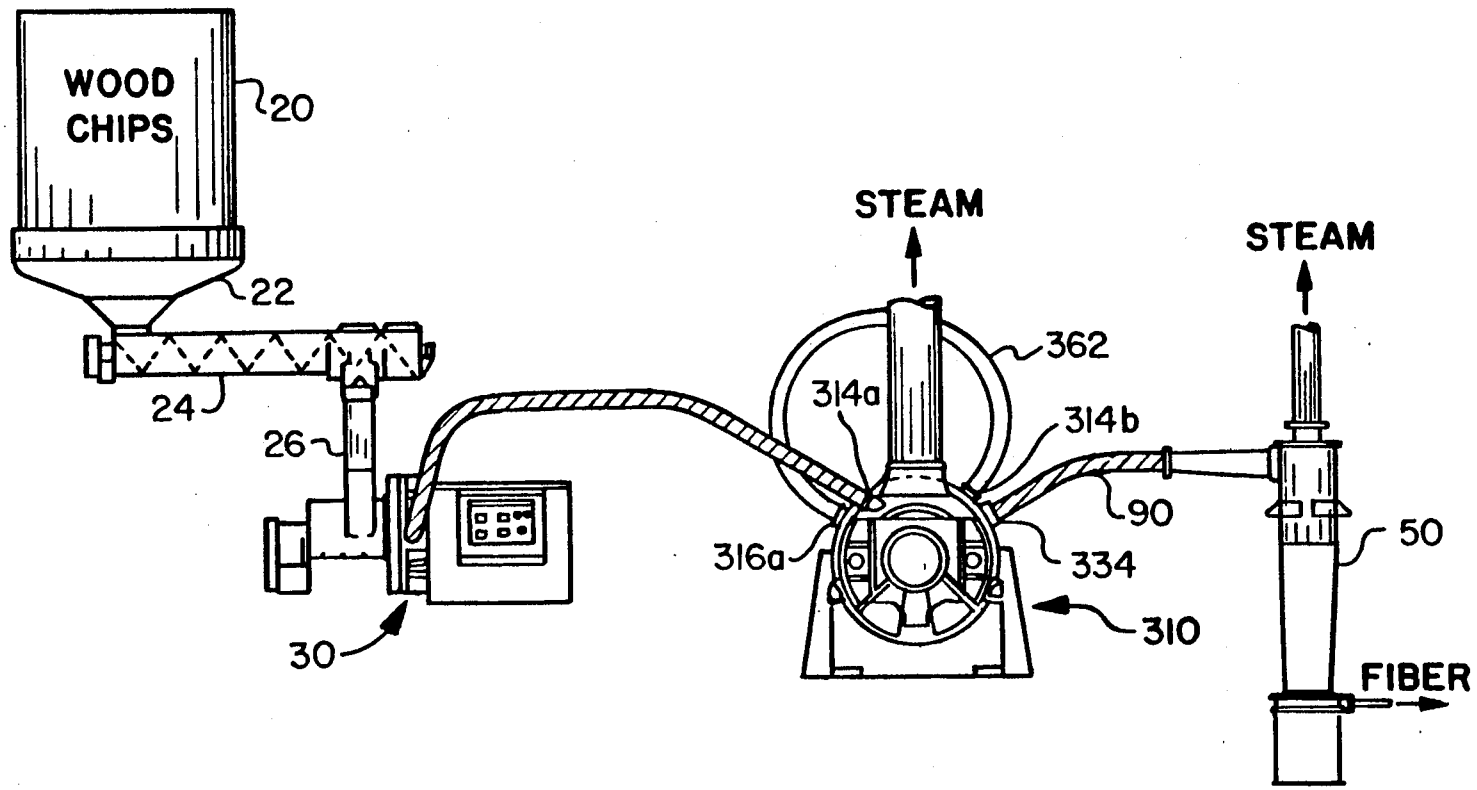
FIG. 4 is an elevational side view of a single high consistency refiner adapted to carry out the process of FIG. 3.

Referring now to the drawing, FIGS. 1 and 2 and V FIGS. 3 and 4 illustrate schematically alternate embodiments and the method of the present invention wherein the lignocellulose material to be refined is processed through two distinct refining stages with the material being transported from the first refining zone, i.e., the upstream refining stage, directly to a ribbon feeder feeding the second refining zone, i.e., the downstream refining stage, via the pressurized steam generated in the first refining zone. Although the method of the present invention will hereinafter be described with reference to wood chips, it is to be understood that the method of the present invention may be applied to refine other forms of lignocellulose containing material.

Figure 5:
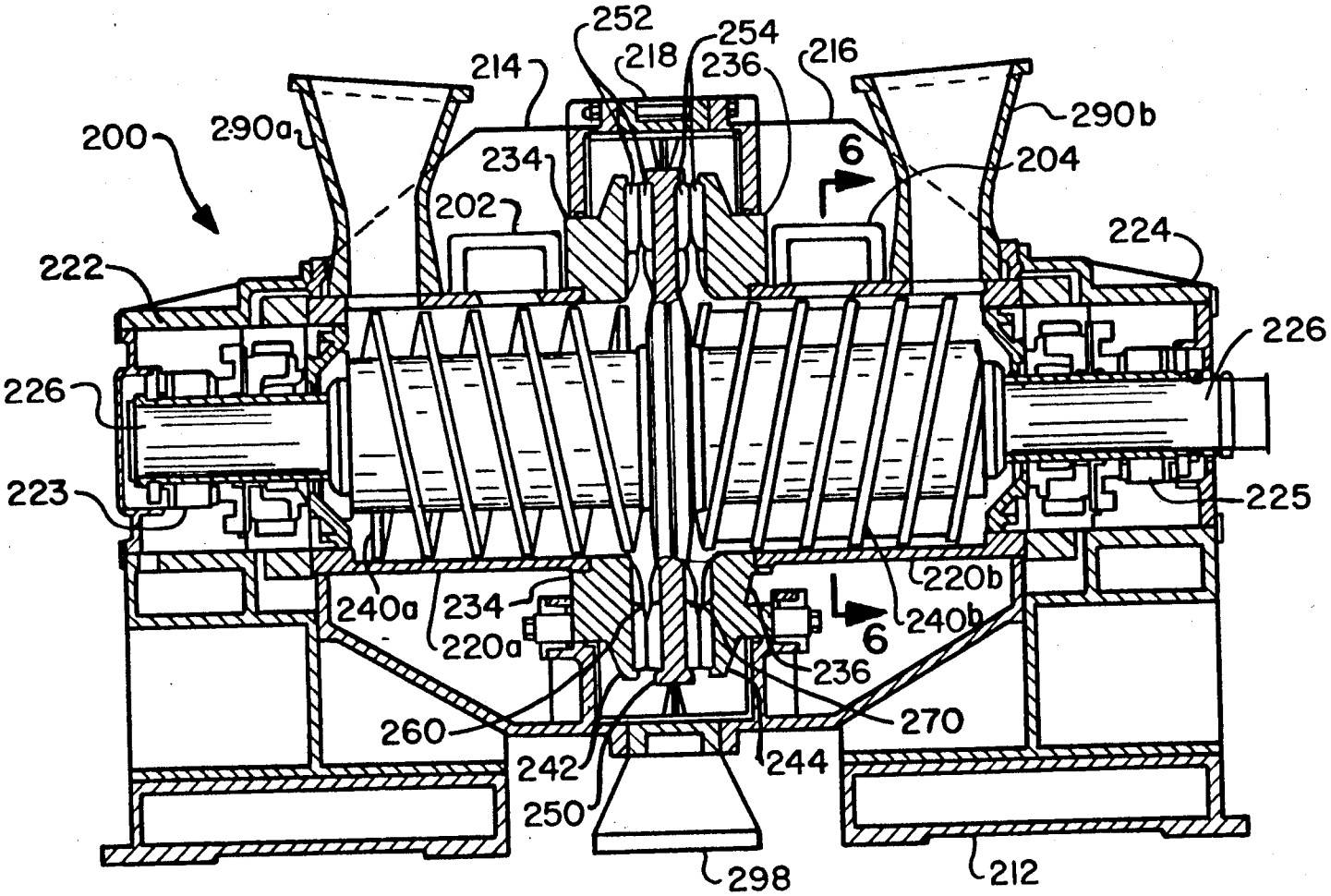
FIG. 5 is a sectional side elevational view of a high consistency refiner as shown in either FIG. 2 and 4.

In the embodiment of the multi-stage method of the present invention illustrated in FIGS. 1 and 2, the refining is carried out using a pair of disc refiners 10,110 disposed in series with respect to the flow of lignocellulose material. Each of the disc refiners 10,110 is the type commonly known as a TWIN refiner, such as disclosed in U.S. Pat. Nos. 3,847,359 or 3,893,631, adapted to carry out the method of the present invention. A TWIN refiner has two separate refining zones defined in a single refiner apparatus, one refining zone on each side of a central rotating disc having attrition plates mounted on each side and flanked on each side by an opposed attrition plate which is rotationally fixed relative to the central rotating disc. A preferred embodiment of a twin refiner adapted for use in the method of the present invention is shown in FIG. 5. It is to be understood, however, that a pair of single disc refiners may be arranged in series to carry out the method of the present invention.

In the embodiment of the multi-stage method of the present invention illustrated in FIGS. 3 and 4, the refining is carried out using a single refiner 210 of the type hereinbefore mentioned. The TWIN refiner illustrated in FIG. 5 is also adaptable to carry out this embodiment of the method of the present invention. When such a refiner is employed to carry out the embodiment of the method of the present invention illustrated in FIGS. 3 and 4, one side of the refiner serves as the first stage or upstream refining zone, while the other side of the refiner serves as the second stage or downstream refining zone. Again, the material being refined is transported directly from the first stage refining zone to a ribbon feeder feeding the second stage refining zone via the pressurized steam generated in the first refining zone.

In the embodiment of the multi-stage pressurized refining process of the present invention illustrated in FIGS. 1 and 2, the cellulosic material to be refined, which typically comprises low content wood chips, is stored in a bin 20 and drops from the hopper 22 thereof into feeder 24, typically a screw feeder. From the feeder 24, the wood chip stock is conveyed at a controlled rate to and drops through chute 26 into the pretreatment apparatus 30 wherein the wood chip stock is mixed with an aqueous solution which may simply comprise water without any chemical additives or may comprise water having dissolved therein various well known pulp treatment chemicals. In any case, the wood chips are mixed with the aqueous solution to form a high consistency slurry, that is a slurry having a solids content of at least 15% by weight, and typically in the range of 20 to 50% by weight, depending on the type of refining apparatus through which the infeed stock is to be later refined. The infeed stock slurry then passes from the inlet chamber of the pretreatment apparatus 30 to the chip fractionator portion 32 thereof wherein the wood chips in the stock slurry are subjected to an initial grinding action which fractionates the chips to separate long fibers therefrom. In the chip fractionation process carried out in the conventional chip fractionator 32 of the pretreatment apparatus 30, the heat generated in the steam and cellulosic fiber mixture.

In accordance with one aspect of the present invention, the fiber and steam mixture discharging from the pretreatment apparatus 30 is passed through feed conduits 34 to the inlet of the first stage refining apparatus 10, the cellulosic fiber and steam mixture being conveyed from the discharge of the pretreatment apparatus 30 through the conduits 34 to the inlet of the refining apparatus 10 via the pressure of the steam in the mixture.

The infeed stock mixture, comprising the fractionated wood chips entrained in steam generated in the chip fractionator passes from the feed conduits into the inlet conduits to the refiner 10 which are arranged to direct the stock mixture tangentially into the ribbon conveyors 40*a*,40*b* in the direction of rotation of the ribbon conveyors. As the tangentially directed stock mixture is received by the ribbon conveyors 40*a*,40*b*, it is advanced by the ribbon conveyors 40*a*,40*b* to the throat of the refining zones on each side of the central rotating disc, the centrifugal forces which act upon the fiber portion of the stock mixture due to the high speed operation of the ribbon conveyors 40*a*,40*b* hold the fiber stock around the periphery of the feeder housing thereby permitting the steam to flow back through the open central region of the ribbon conveyors 40*a*,40*b* to the outer end of the feeder housing and through the steam discharge passages of the refiner 10 to be vented or preferably, passed to a heat recovery system. The fractionated fiber stock is delivered axially by the ribbon conveyors 40*a*,40*b* to the throat of the refining zones on opposite sides of the central rotating disc and is driven by centrifugal force of the rotating disc through the refining zones formed between the stationary plates into the peripheral region of the refiner casing and out through the refiner outlets as a partially refined pulp 13 entrained in steam generated within the refining zone when the heat generated during the refining process evaporates water present in the infeed stock 11.

The mixture of partially refined pulp and steam generated 13 is conveyed through the transfer conduits 62*a*,62*b* which respectively interconnect the discharge outlets 16*a*,16*b* of the first and second refining zones of the refiner 10 to the inlet conduits 114*a*,114*b* to the downstream refiner 110. The partially refined pulp and steam mixture received through the infeed conduits 114*a*,114*b* is directed tangentially into the ribbon conveyors and advanced by the ribbon conveyors 140*a*,140*b* towards the refining zones on each side of the central rotating disc of the downstream refiner 110. Due to the high speed operation of the ribbon conveyors 140*a*,140*b* the partially refined pulp stock is held around the peripheral of the feeder housing about the ribbon conveyors 140*a*,140*b* while the steam in the infeed mixture flows back through the open central region of the ribbon conveyors 140*a*,140*b* along the ribbon drive shaft to the steam discharge outlets of the downstream refiner 110 disposed at the outer ends of the housing surrounding the ribbon conveyors 140*a*,140*b*. The partially refined pulp stock is delivered axially by the ribbon conveyors 140*a*,140*b* through the throats of the refining zones on opposite sides of the central rotating disc and is driven by centrifugal force through the refining zones between the refining plates into the peripheral region of the casing of the downstream refiner 110 and thence through the refiner outlet 134 as a refined product pulp 113 entrained in steam generated by evaporation of water present in the partially refined pulp by the refining heat generated during the grinding operation carried out in the refining zones of the downstream refiner 110.

The refined pulp stock and steam mixture 113 is discharged from the downstream refiner 110 through the exhaust conduit 90 to a steam separating means 50, most commonly a cyclone separator wherein the steam in the mixture is separated from the refined pulp stock. The steam 55 separated from the mixture of refined pulp stock and steam 113 discharged from the secondary refiner 110 may be vented to atmosphere or, preferably, passed to a heat recovery system together with the steam 15 and 115 vented from the upstream and downstream refiners through the ribbon conveyors 40*a*,40*b*,140*a*,140*b*. The refined pulp stock separated from the mixture 113 in the separation means 50 is discharged therefrom and collected in a latency chest as the refined product pulp.

In the embodiment of the process of the present invention illustrated in FIGS. 3 and 4, the infeed stock mixture 11, comprising the fractionated wood chips entrained in steam generated in the chip fractionator passes through a single feed conduit into the first inlet conduit 314*a* to the refiner 310 and is directed via the first inlet conduit 314*a* tangentially into the ribbon conveyor in the direction of rotation of the ribbon conveyor. As the stock mixture is advanced by the ribbon conveyor 340*a* to the throat of the first refining zone on the upstream side of the central rotating disc, the centrifugal forces which act upon the fiber portion of the stock mixture due to the high speed operation of the ribbon conveyor 340*a* hold the fiber stock around the periphery of the feeder housing thereby permitting the steam to flow back through the open central region of the ribbon conveyor 340*a* to the outer end of the feeder housing and through the steam discharge passage of the refiner 310 to be vented or preferably, passed to a heat recovery system. The fractionated fiber stock is delivered axially by the ribbon conveyor 340*a* to the throat of the first refining zone on the upstream side of the central rotating disc and is driven by centrifugal force of the rotating disc through the first refining zone into the peripheral region of the refiner casing and out through the first refiner outlet 316*a* as a partially refined pulp 13 entrained in steam generated within the refining zone when the heat generated during the refining process evaporates water present in the infeed stock 11.

The mixture of partially refined pulp and steam generated 13 is conveyed through the transfer conduit 362 which interconnects the discharge outlet 316*a* of the first refining zone of the refiner 310 to the second inlet conduit 314*b* to the second refining zone of the refiner 310. The partially refined pulp and steam mixture is directed through the second inlet conduit 314*b* tangentially into the ribbon conveyor 340*b* and is advanced by the ribbon conveyor 340*b* towards the second refining zone on the opposite side of the central rotating disc of the refiner 310. Due to the high speed operation of the ribbon conveyor 340*b* the partially refined pulp stock is held around the periphery of the feeder housing about the ribbon conveyor 340*b* while the steam in the infeed mixture flows back through the open central region of the ribbon conveyor 340*b* along the ribbon drive shaft to the steam discharge outlet of the refiner 310 disposed at the outer end of the housing surrounding the ribbon conveyor 340*b*. The partially refined pulp stock is delivered axially by the ribbon conveyor 340*b* through the throat of the second refining zone and is driven by centrifugal force through the second refining zone and thence through the refiner outlet 334 as a refined product pulp 113 entrained in steam generated by evaporation of water present in the partially refined pulp by the refining heat generated during the grinding operation carried out in the refining zones of the refiner 310.

The refined pulp stock and steam mixture 113 is discharged from the refiner 310 through the exhaust conduit 90 to the steam separating means 50, most commonly a cyclone separator wherein the steam in the mixture is separated from the refined pulp stock. The steam 55 separated from the mixture of refined pulp stock and steam 113 discharged from the secondary refiner 310 may be vented to atmosphere or, preferably, passed to a heat recovery system together with the steam 15 and 115 vented from the upstream and downstream 10 refining zones through the ribbon conveyors 340*a* and 340*b*. The refined pulp stock separated from the mixture 113 in the separation means 50 is discharged therefrom and collected in a latency chest as the refined product pulp.

Referring now to FIG. 5 of the drawings, there is depicted therein a refining apparatus, commonly referred to as a Twin refiner, adapted for carrying out the process of the present invention either in the embodiment illustrated in FIGS. 1 and 2 or the embodiment illustrated in FIGS. 3 and 4. The refiner 200 comprises a base 212 supporting spaced separable casing sections 214,216 and a central casing section 218 which is removably secured between the sections 214,216 to provide access to the refining zones to permit maintenance of the apparatus and replacement of the refiner plates. Bearing support housings 222,224 extend outwardly from the casing sections 214,216, respectively, to house bearing assemblies 223,225, respectively, which rotatably support the refiner drive shaft 226 which extends between the bearing assemblies through the casing sections. Drive means (not shown) for rotating the rotor shaft 226 typically comprises a motor mounted on an adjustable motor base independent from the refiner base and connected to the rotor shaft 226 either via a direct gear coupling or by a belt drive.

The casing sections 214,216 respectively include non-rotating annularly shaped heads 234,236 which are disposed perpendicularly to the axis of the drive shaft 226 and extend circumferentially about the drive shaft 226 in spaced relationship between the casings 214,216 within the annular central casing 218 mounted therebetween. The heads are secured to their respective casings and have mounted thereto refiner plate assemblies 242,244, respectively, on the opposed facing surfaces of the heads 234,236. The refining plate assemblies each comprise a conventional array of refining plate elements well known in the art, such as those in U.S. Pat. No. 3,473,745.

A radially extending rotor disc 250 is centrally mounted on the rotor shaft 226 within the central casing 218 intermediate the spaced non-rotating heads 234,236 and is keyed to the rotor shaft 226 for rotation therewith. Sets of refining plates 252,254 of conventional construction are mounted to the opposite faces of the central rotor disc 250 to face the axially juxtaposed refiner plates 242 and 244 and define a first refining zone 260 between the spaced refiner plates 242 and 252 and a second refining zone 270 between the spaced refiner plates 244 and 254.

In order to defibrate lignocellulose material at high consistency in accordance with the process of the present invention, the refiner 200 is equipped with two separate and distinct feeder means, the first feeder means disposed within the refiner casing section 214 in operative association with the first refining zone 260 and the second feeder means disposed within the refiner casing section 216 in operative association with the second refining zone 270. In the refiner apparatus of the present invention, at least of the feeder means, generally the downstream feeder means, and preferably, both of the first and second feeder means are adapted to directly receive a mixture of lignocellulose material and superatmospheric pressure steam from an upstream refining zone or pretreatment stage, thereby avoiding the necessity of innerstage separation of the lignocellulose material from the steam as required in conventional refiners operating a high consistency. The first and second feeder means embodied in the Twin refiner illustrated in FIG. 5 are both adapted as hereinafter described to receive a mixture of lignocellulose material and steam and for conveying the lignocellulose into its associated refining zone while passing the steam in the opposite direction to the flow of lignocellulose material and away from the refining zone to a steam vent.

Figure 6:
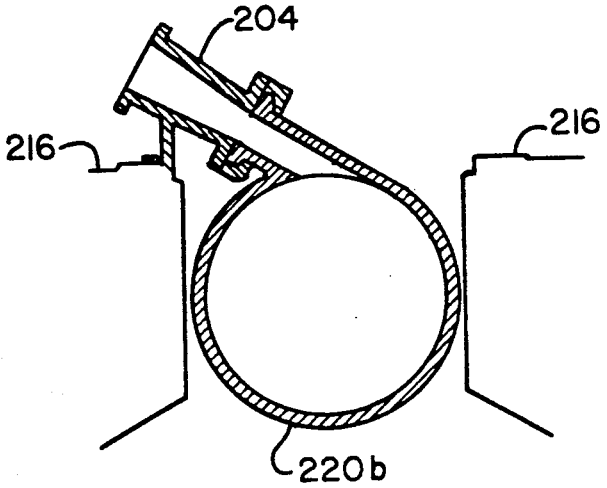
FIG. 6 is a sectional elevational view taken along line 6—6 of FIG. 5.

Referring now to FIGS. 5 and 6, inlet conduits 202 and 204 are respectively mounted to and open into the casing sections 214 and 216 for directing the lignocellulose material to be processed tangentially into the ribbon conveyors feeding the first and second refining zones 260 and 270, respectively. The longitudinally elongated conveyor housings 220*a*,220*b* extend coaxially with the rotor shaft 226 on each side of the central rotor disc 250, one extending within the refiner casing section 214 and having a discharge outlet opening to the throat of the first refining zone 260, and the other extending within the refiner casing section 216 and having a discharge outlet opening to the throat of the second refining zone 270. As best seen in FIG. 6, the inlet conduits 202, 204 extend exteriorly respectively of the refiner casing sections 214 and 216 and open respectively to the conveyor housings 220*a*,220*b* to direct the mixture of lignocellulose material and steam from a supply conduit tangentially into the conveyor housings 220*a*,220*b*. Ribbon conveyors 240*a* and 240*b* are mounted respectively within the conveyor housings 220*a* and 220*b* and are keyed to the rotor shaft 226 for rotation therewith. The ribbon conveyors are 240a and 240b are essentially identical aside from the opposite pitch of the spiral ribbon elements mounted about the conveyor shaft whereby material is fed in opposite directions toward the central rotor disc 250 from rotation of the shaft 226. The ribbon conveyor illustrated in U.S. Pat. No. 3,441,227, the disclosure of which is hereby incorporated herein by reference, may be utilized, as well as thereof, as the ribbon conveyors 240a and 240b.

As noted hereinbefore, upon rotation of the ribbon conveyors 240a and 240b, the lignocellulose material is separated from the steam in which it has been conveyed into the conveyor housing. The centrifugal forces generated by the high speed rotation of the ribbon conveyors throw and hold the lignocellulose material around the periphery of their conveyor housings while permitting the steam to flow in reverse direction through the central open portion of each ribbon conveyor. Steam vents 290a and 290b, mounted respectively to the refiner casing sections 214 and 216, open to the conveyor housings 220a,220b, respectively, and extend therefrom exteriorly of the refiner casing sections 214 and 216 to provide a flow conduit for venting the separated steam from the conveyor housings. The steam vents are disposed so as to open into that end of each conveyor housing which is axially remote from the central rotor disc 250. As the ribbon conveyors 240a and 240b rotate, the lignocellulose material is advanced along the axis of the conveyor housings into the first and second refining zones, respectively, while the steam separated from the received mixture passes axially outwardly through the open central portion of each ribbon conveyor oppositely to flow of lignocellulose material to and through the steam vents 290.

A discharge conduit means 298, mounted to the center refiner casing section 218, communicates with the annular chamber therein for providing a discharge conduit for passage of refined and/or partially refined material from the refiner. If the output materials discharged from the first and second refining zones are to be passed to a common receptacle, then the discharge conduit means 298 may comprise a single outlet passage opening through the center refiner casing section 218 to receive material discharged from both the first and second refining zones. If the output materials discharged from the first and second refining zones are to be passed to different receptacles, then the discharge conduit means 298 comprises a pair of independent outlet passages, both opening through the center refiner casing section 218, but with one outlet passage arranged to receive only material discharged from the first refining zone and with the other outlet passage arranged to receive only material discharged from the second refining zone.

Although the refiner apparatus illustrated in FIG. 5 is of type commonly referred to as a Twin refiner wherein two separate and distinct refining zones are housed in the same refiner casing, it is to be understood that a single-disc type refiner apparatus, such as disclosed in U.S. Pat. No. 3,441,227, may be adapted to carry-out the process of the present invention by equipping the refiner apparatus with a feeder means adapted as hereinbefore described to receive a mixture of lignocellulose material and steam and convey the lignocellulose material into the refining zone while passing the steam in the opposite direction to the flow of lignocellulose material and away from the refining zone to a steam vent. For example, the single disc refiner apparatus disclosed in U.S. Pat. No. 3,441,227, may be modified to directly receive a mixture of lignocellulose material and superatmospheric pressure steam, rather than lignocellulose material from which the steam has previously been removed via a cyclone separator or the like, by providing an inlet conduit which passes through the refiner casing and opens to the housing of the feeder means at a location intermediate the refining zone and the steam vent so as to direct the lignocellulose material and steam mixture tangentially into the ribbon conveyor in the same direction as the rotation of the ribbon conveyor.

Figure 7:
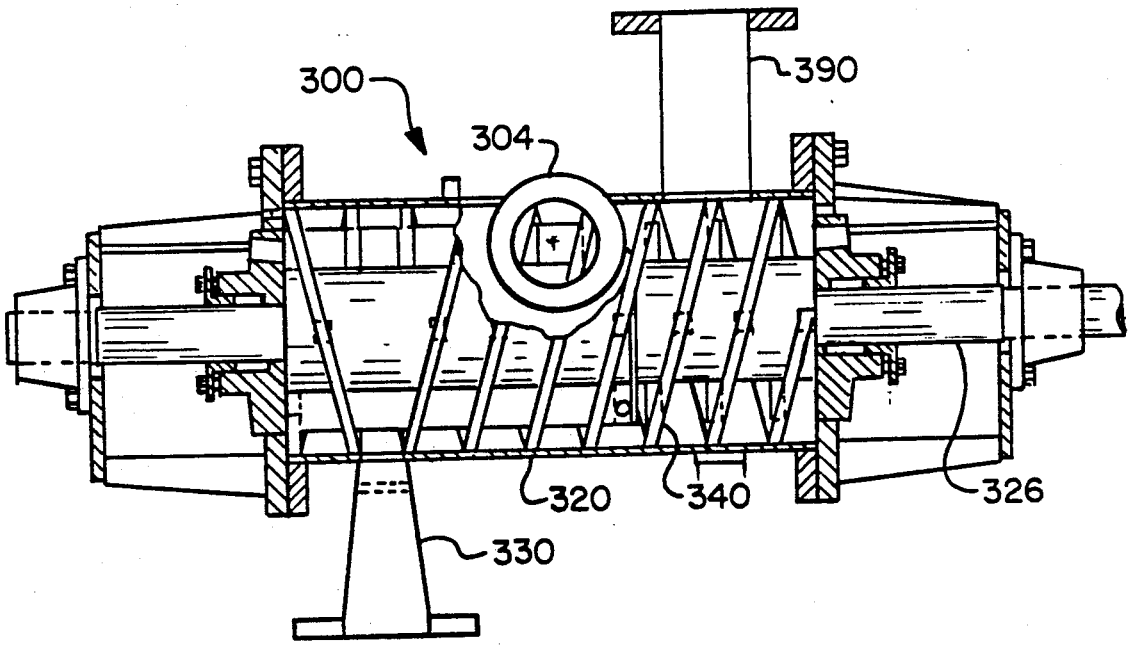
FIG. 7 is a side elevational view, partly in section, of separation apparatus embodying the concept of the present invention.

The feeder means embodied in the refiner apparatus of the present invention illustrated in FIGS. 5 and 6, may also be utilized as a stand alone steam separator 300 as shown in FIG. 7. The steam separator 300 comprises an axially elongated housing 320 having a lignocellulose discharge outlet 330 opening therefrom at one axial end thereof and a steam vent 390 opening therefrom at the other axial end thereof for venting steam from the separator. Conveyor means 340, most advantageously a ribbon conveyor, is mounted within the housing 320 about a rotatable drive shaft 326 disposed along the axis of the housing 320 and adapted for rotation about its axis by conventional motorized drive means (not shown). The conveyor means 340 is keyed to the drive shaft 326 so as to rotate therewith. An inlet conduit 304 opens to the housing 320 at a location intermediate the lignocellulose material discharge outlet 330 and the steam vent 390 to receive a mixture of lignocellulose material and superatmospheric pressure steam and direct the received mixture tangentially into the ribbon conveyor means 340 in the direction of the rotation of the conveyor means. Upon rotation of the ribbon conveyor means 340 at high speed, the lignocellulose material is separated from the steam in which it has been conveyed into the conveyor housing. The centrifugal forces generated by the high speed rotation of the ribbon conveyor throws and holds the lignocellulose material around the periphery of the conveyor housing while the lignocellulose material is conveyed to the discharge outlet 330 and the steam is permitted to flow in reverse direction through the central open portion of the ribbon conveyor to the steam vent 390.

The method of the present invention, and the systems disclosed herein for carry out said method, wherein the lignocellulose material being refined is transported between stages pneumatically by the steam generated during the processing rather than mechanically transported, allows for the optimization of pulp quality and steam recovery at maximum pressure. Transport of the lignocellulose in the steam generated during processing as taught herein permits up to a fifty percent reduction in dwell time of the pulp at pressure and therefore allows operation and steam recovery at higher pressure without the undesirable excessive darkening of the pulp experienced when the pulp is exposed to a pressurized environment for longer periods. The use of process steam transport also eliminates the need for interstage mechanical equipment, including screw conveyors and interstage cyclone separators for steam removal, thereby substantially reducing capital expenditures, reducing maintenance costs, reducing system complexity, and improving reliability.

We claim:

1. A disc type refiner for defibrating lignocellulose material at high consistency, said refiner comprising:

casing means;

a rotatable drive shaft extending through said casing means;

a central disc mounted to said rotatable drive shaft for rotation therewith, said central disc having a grinding surface on both face surfaces thereof;

a first stationary disc disposed within said casing means in close relationship to said central disc on one side thereof, said first disc having a grinding surface on a face thereof facing in opposed relationship one of the grinding surfaces of said central disc thereby defining a first refining zone therebetween;

a second stationary disc disposed within said casing means in close relationship to said central disc on the other side thereof, said second disc having a grinding surface on a face thereof facing in opposed relationship to the other of the grinding surfaces of said central disc thereby defining a second refining zone therebetween;

first feeder means disposed in said casing in operative association with said first refining zone for conveying the lignocellulose material to be refined into the first refining zone wherein the lignocellulose material is subjected to refining action whereby a mixture of partially refined lignocellulose material and superatmospheric pressure steam is produced in the first refining zone at a first pressure;

second feeder means disposed in said casing in operative association with said first refining zone for receiving the mixture of partially refined lignocellulose material and superatmospheric pressure steam produced in said first refining zone and conveying the partially refined lignocellulose material into the second refining zone while passing the steam away from the second refining zone, said second feeder means comprising:

a. housing means coaxially disposed about said rotatable drive shaft and having a lignocellulose discharge outlet opening to the second refining zone;

b. a steam discharge outlet passing through the casing and opening to the housing means at a location axially spaced from said lignocellulose discharge outlet of the housing means;

c. inlet conduit means passing through said casing and opening to the housing at a location intermediate said lignocellulose material discharge outlet and said steam discharge outlet of the housing means for receiving the mixture of lignocellulose material and superatmospheric pressure steam from the first refining zone and directing said mixture tangentially into a region of the housing means at said location that is at a second pressure lower than said first pressure; and d. conveyor means disposed within the housing means and supported on said rotatable drive shaft to rotate therewith for upon rotation conveying the lignocellulose material from the inlet conduit opening to the housing means through the lignocellulose discharge outlet opening of the housing means into the second refining zone while passing the superatmospheric pressure steam in reverse direction to the lignocellulose material to vent the steam through the steam discharge outlet of the housing means; and transport conduit means in flow communication between the first referring zone and the inlet conduit opening to the housing means of said second feeder means for transporting the mixture of partially refined lignocellulose material and superatmospheric steam produced in the first refining zone directly from the first refining zone to the inlet conduit opening to the housing means of said second feeder means.

2. A disc-type refiner as recited in claim 1 wherein said conveyor means of said second feeder means comprises a ribbon conveyor supported on said rotatable drive shaft for rotation therewith.

3. A disc-type refiner as recited in claim 2 wherein said housing means of said second feeder means comprises a longitudinally elongated cylindrical conduit means mounted coaxially about said rotatable drive shaft, said conduit means defining a cylindrical wall disposed in closely spaced relationship about said ribbon conveyor.

4. A disc-type refiner as recited in claim 1 wherein said first feeder means disposed within said casing in operative association with said first refining zone comprises:

a. housing means coaxially disposed about said rotatable drive shaft and having a lignocellulose discharge outlet opening to the first refining zone;

b. a steam discharge outlet passing through the casing and opening to the housing means at a location axially spaced from said lignocellulose discharge outlet of said housing means;

c. inlet conduit means passing through said casing and opening to the housing at a location intermediate said lignocellulose material discharge outlet and said steam discharge outlet of the housing means for receiving a mixture of lignocellulose material to be refined and superatmospheric pressure steam and directing said mixture tangentially into the housing means; and d. conveyor means disposed within the housing means and supported on said rotatable drive shaft to rotate rotation therewith for upon rotation conveying the lignocellulose material from the inlet conduit opening to the housing means through the lignocellulose discharge outlet opening of the housing means into the first refining zone while passing the superatmospheric pressure steam in reverse direction to the lignocellulose material to vent the steam through the steam discharge outlet of the housing means.

5. A disc-type refiner as recited in claim 4 wherein said conveyor means of said first feeder means comprises a ribbon conveyor supported on said rotatable drive shaft for rotation therewith.

6. A disc-type refiner as recited in claim 5 wherein said housing means of said first feeder means comprises a longitudinally elongated cylindrical conduit means mounted coaxially about said rotatable drive shaft, said conduit means defining a cylindrical wall disposed in closely spaced relationship about said ribbon conveyor.

* * * * *